US008212186B2

(12) United States Patent
Kaizuka

(10) Patent No.: US 8,212,186 B2
(45) Date of Patent: Jul. 3, 2012

(54) PLUG-IN HEATER FOR HOT CURLERS

(75) Inventor: Kazutoshi Kaizuka, Fukuoka (JP)

(73) Assignee: Create Co., Ltd., Fukuoka (JP)

( * ) Notice: Subject to any disclaimer, the term of this patent is extended or adjusted under 35 U.S.C. 154(b) by 535 days.

(21) Appl. No.: 12/570,118

(22) Filed: Sep. 30, 2009

(65) Prior Publication Data

US 2010/0270281 A1 Oct. 28, 2010

(30) Foreign Application Priority Data

Apr. 24, 2009 (JP) ..... 2009-002682

(51) Int. Cl.
*A45D 1/04* (2006.01)

(52) U.S. Cl. ..... 219/226; 219/221; 219/222; 219/224

(58) Field of Classification Search ..... 219/221, 219/222, 224, 226
See application file for complete search history.

(56) References Cited

U.S. PATENT DOCUMENTS 298,028 A * 5/1884 Mizobata ..... 432/76
4,284,877 A * 8/1981 Abura et al. ..... 219/222
4,857,702 A * 8/1989 Cafaro ..... 219/225
2008/0169278 A1* 7/2008 Kaizuka ..... 219/226

* cited by examiner

*Primary Examiner* — Wai Sing Louie
(74) *Attorney, Agent, or Firm* — Warner Norcross & Judd LLP

(57) ABSTRACT

A plug-in heater for hot curlers is constituted in the following manner: because the power plug can be positioned at the storage location, it is constituted to possess a compact size; in particular, because the power plug can be positioned at the protruding positions in two perpendicular directions (a rear-side protruding direction and a lower-side protruding direction), the range for inserting the power plug can be expanded even when the electrical outlet is located at different locations at the housing facilities. Plug-storing groove 15 is formed extending from upper surface (10) to lower surface (13) of the main body case, the base of power plug 2 is rotatably supported at a lower position within plug-storing groove 15 above, power plug 2 is formed so as to be positioned around the rotatably-supporting point at an upward storing position P1, at a rear-side protruding position P2, and at a lower-side protruding position P3, and locking means 3 and 4 are formed for positioning and fixating the power plug at these positions.

1 Claim, 5 Drawing Sheets

PLUG-IN HEATER FOR HOT CURLERS

The present invention relates to a plug-in heater for hot curlers constituted with a main body case equipped with a power plug, and which serves to heat hot curlers that are mounted onto the main body in a freely mountable/removal manner to a certain temperature.

A heater for heating hot curlers is constituted in a manner in which standbosses are provided on the upper surface of its main case in a protruding condition, and a terminal socket is provided within the standboss. Moreover, when a hot curler is inserted into the standboss from the above so as to cover the standboss and a pug-in terminal is plugged into the terminal socket, a heating element incorporated within the curler is caused to generate heat in order to heat the hot curler. Power is supplied to the terminal socket from an AC power source. However, there has been no heater for hot curlers that is constituted with a main body case equipped with a power plug as the means for supplying the power.

However, a plug-in electrical appliance of which the main body is equipped with a power plug as the means for supplying power has been traditionally known (see Patent Literature 1).

The above-stated traditional plug-in electric appliance was constituted in a manner in which the power plug was provided on the lower surface of the main body case in a foldable manner, and the power plug formed in a manner so that it could be positioned at a storage position along the lower surface of the main body case as well as at a downward protruding position protruding downward from the lower surface of the main body case. As stated above, although the traditional plug-in electrical appliance was constituted in a manner in which the power plug could be positioned at these two positions, namely at the storage position and at the protruding position, the protruding position was facing in only one direction.

[Prior Art Literature] [Patent Literature]

[Patent Literature] Official Gazette of Patent #2000-277201

In recent years, there are more people who carry hot curlers with them when they go on trips so that they may be able to take care of their hair on such trips, which has created the necessity for carrying a heater to accompany the use of the hot curlers. At accommodations on such trips, power has been supplied from an electrical outlet to the heater. The electrical outlet might be located on a wall, close to the floor, on a bathroom counter, on a desk, at a corner of some sort of equipment such as a bed, or at a location requiring an extension cord. In this manner, the location of the electrical outlet greatly varies depending on the accommodation facilities.

With the traditional plug-in electrical appliance, when the power plug has been positioned at the storage position, it has been possible to house the power plug within the main case, contributing to the compact size of the traditional model, which has been advantageous. However, when such appliance has been in use, because the protruding position has faced in only one direction, it might become difficult to insert the power plug into an electrical outlet, depending on the location of the electrical outlet.

In particular, with regards to a heater for hot curlers, when the hot curlers have been mounted on standbosses, the resulting entire length becomes so high that the direction in which the power plug is inserted is more likely to be restricted, and thus it becomes impossible to insert the power plug into an electrical outlet in some cases, which has been problematic.

The purpose of the present invention is to provide a plug-in heater for hot curlers constituted in the following matter:

because the power plug may be positioned at one storage location and two protruding positions, it may be constituted so as to possess a compact size, due to positioning of the power plug at the storage location, and in particular, because the power plug may be positioned at protruding positions in two perpendicular directions (a rear-side protruding direction and a lower-side protruding direction), the range for inserting the power plug can be expanded even when the electrical outlet is located at different locations on the housing facilities.

In order to solve the problems stated above, the plug-in heater for hot curlers (hereafter, abbreviated as the "plug-in heater") of the present invention is constituted as follows: A plug-in heater for hot curlers comprising standbosses (11) for hot curlers on upper surface (10) of main body case (1), a terminal socket (12) for connecting a plug-in terminal (T) for hot curlers (H) provided within the standbosses, and a power plug (2) electrically connected to the terminal socket incorporated within the main body case, wherein a plug-storing groove (15) is formed on the rear surface (14) of the main body case extending from the upper surface [reference numeral (10) missing here] to the lower surface (13) of the main body case, the base of the power plug is rotatably supported by means of a shaft at a lower position within the plug-storing groove, the power plug is formed so as to be positioned around the rotatably-supporting point at an upward storing position (P1) at which the tip of the power plug slightly protrudes from the upper surface of the main body case, at a rear-side protruding position (P2) at which the tip of the power plug protrudes from the rear side of the main body case, and at a lower-side protruding position (P3) at which the tip of the power plug protrudes from the lower surface of the main body case, and locking means (3) and (4) for fixating the power plug at the upward storing position, rear-side protruding position, and lower-side protruding position.

The plug-in heater of the present invention is characterized by a constitution in which the power plug is formed so as to be positioned at the upward storing position, rear-side protruding position, and lower-side protruding position. Therefore, when the power plug is positioned at the upward storing position, the power plug is accommodated within the main body case without greatly protruding from the main body case; thus, the entirety of the plug-in heater can be formed in a compact size. Moreover, at the upward storing position, as the tip of the power plug slightly protrudes from the upper surface of the main body case, when the user wishes to shift the position of the power plug from the upward storing position to the protruding positions, the protruding tip may be used as the handle.

Furthermore, because the two protruding positions, namely the rear-side protruding position and the lower-side protruding position, both run in the perpendicular direction, the direction to plug in the power plug can be selected from these protruding positions in two different perpendicular directions. Thus, the possible range for inserting the power plug can be expanded to double, even when the electrical outlet is located at different locations on the housing facilities.

DESCRIPTION OF CURRENT EMBODIMENTS

Figure 1:
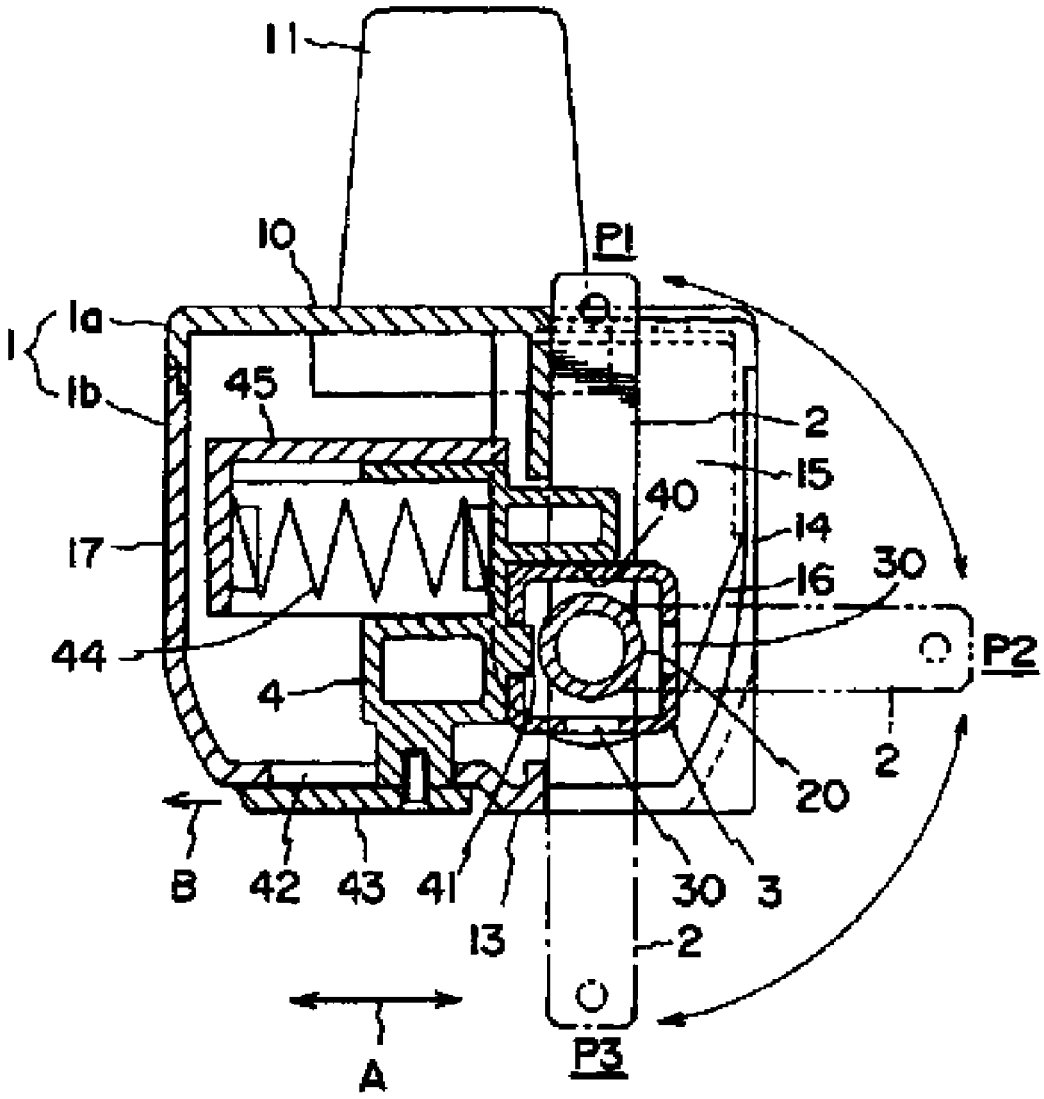
FIG. 1 is a cross-sectional view showing the essential portion of the plug-in heater of the working example of the present invention.

The plug-in heater of the present working example is equipped with main body case 1 which is constituted by upper case 1*a* and lower case 1*b*. Two standbosses 11 for mounting hot curlers in a freely mountable/removable manner are provided in a protruding condition on upper surface 10 of main body case 1. Terminal socket 12 (shown in FIG. 3) is provided within standboss 11.

Figure 4:
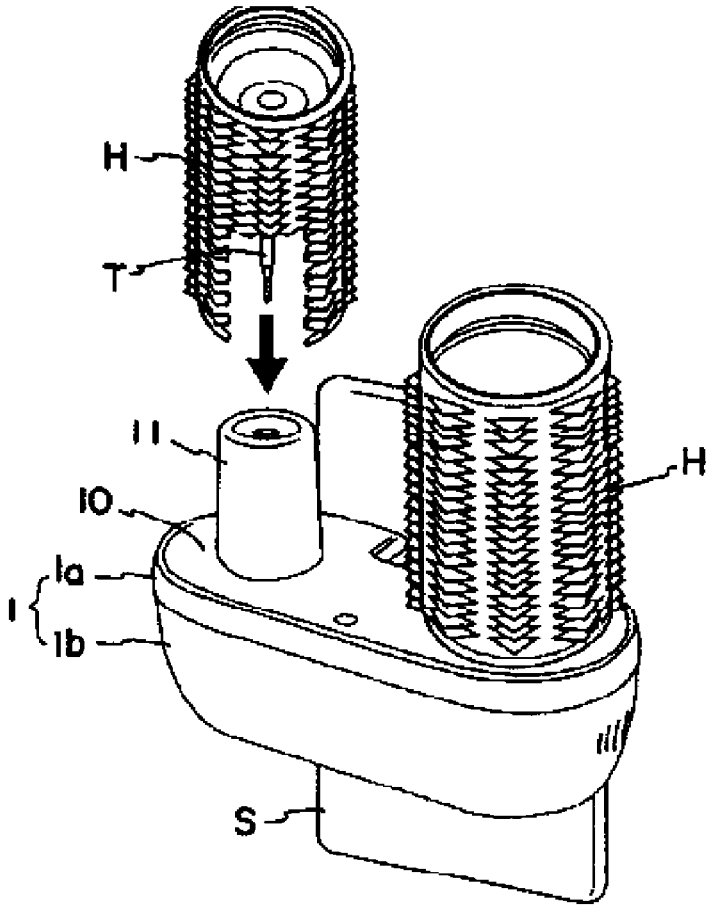
FIG. 4 is an oblique view of the above plug-in heater in use.

In using the plug-in heater, as shown if FIG. 4, when hot curler H is inserted into the standboss from above so as to cover the standboss and plug-in terminal T is plugged into terminal socket 12, a heating element (not shown in the figures) incorporated within the curler is caused to generate heat so as to heat the hot curler. Moreover, in FIG. 4, reference numeral S represents a cover for power socket.

Main body case 1 is equipped with power plug 2 as the power supply means, and power plug 2 is electrically connected to terminal socket 12 through wiring parts such as cables, fuse, etc. (omitted in the figures).

Power plug 2 is formed with two parallel plug blades 2*a* and 2*a*, plug-storing groove 15 is formed on the rear surface 14 of the main body case extending from the upper surface 10 to the lower surface 13 of the main body case, and the base of the power plug is rotatably supported within plug-storing groove 15 by means of rotating axis 20 constituted as the insulator.

Moreover, power plug 2 is formed so as to be positioned at an upward storing position (P1) at which the tip of the power plug slightly protrudes from upper surface 10 of main body case 1, at a rear-side protruding position (P2) at which the tip of the power plug protrudes from the rear side of the main body case, and at a lower-side protruding position (P3) at which the tip of the power plug protrudes from the lower surface of the main body case. As stated above, the base of the power plug is rotatably supported at a lower position within plug-storing groove 15 so that power plug 2 may be positioned at the upward storing position P1, rear-side protruding position P2, and lower-side protruding position P3.

Figure 2:
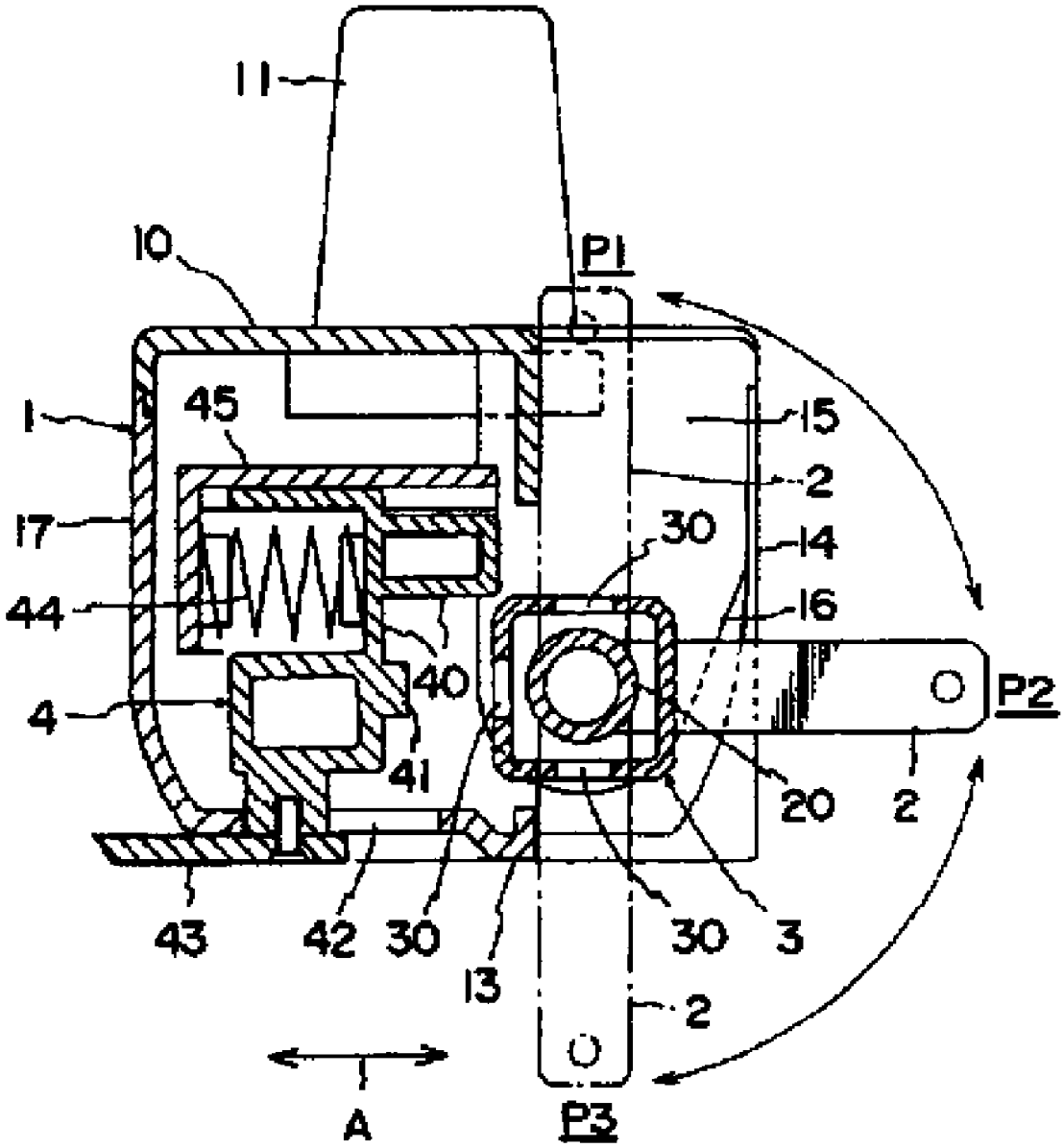
FIG. 2 is a cross-sectional view showing the essential portion of the above plug-in heater.
Figure 3:
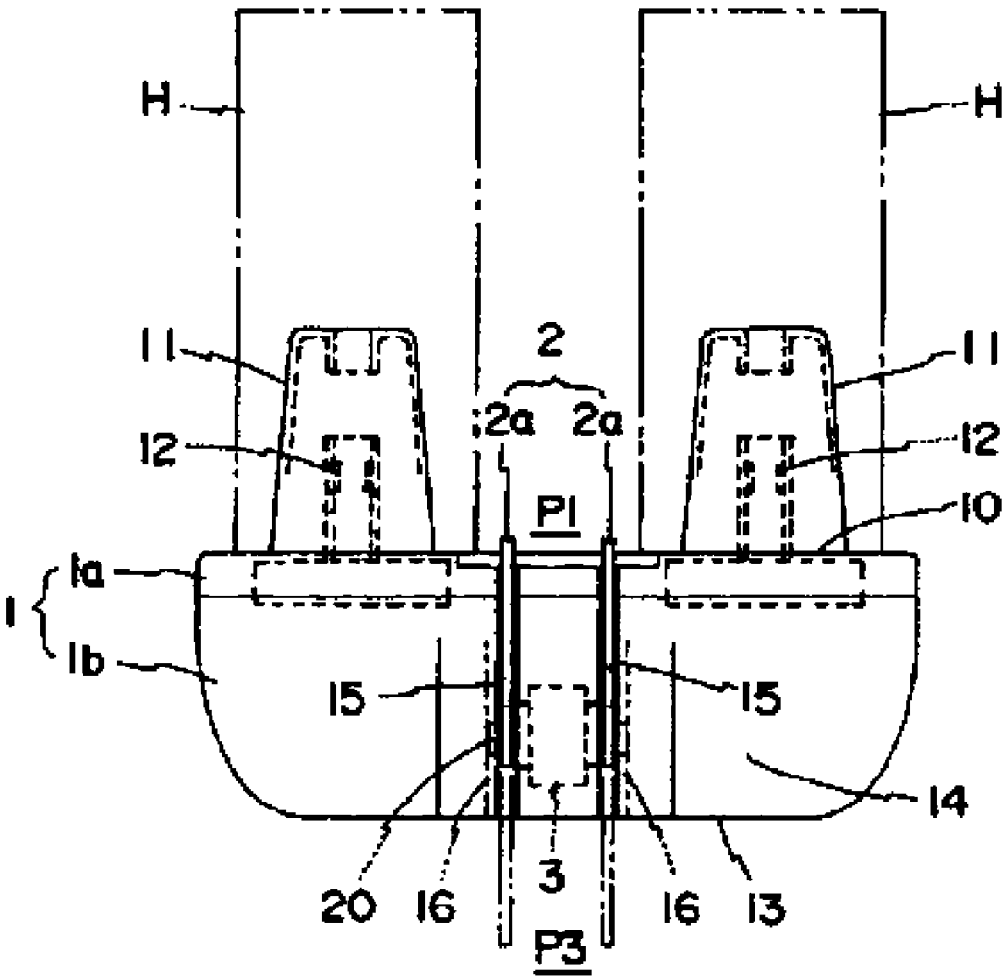
FIG. 3 is a back view of the above plug-in heater.
Figure 5:
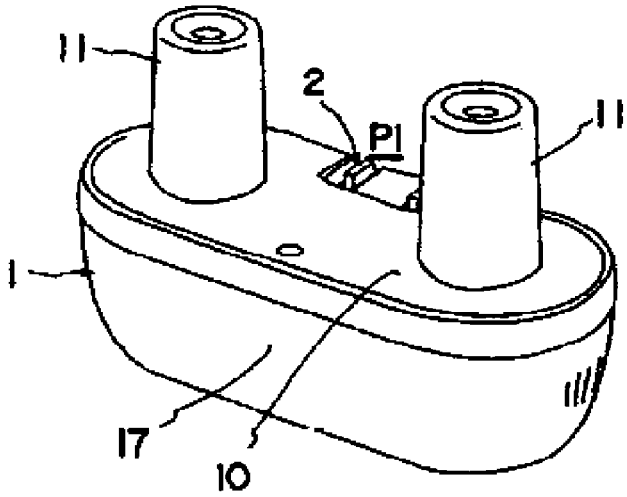
FIG. 5 is an oblique view of the above plug-in heater.
Figure 6:
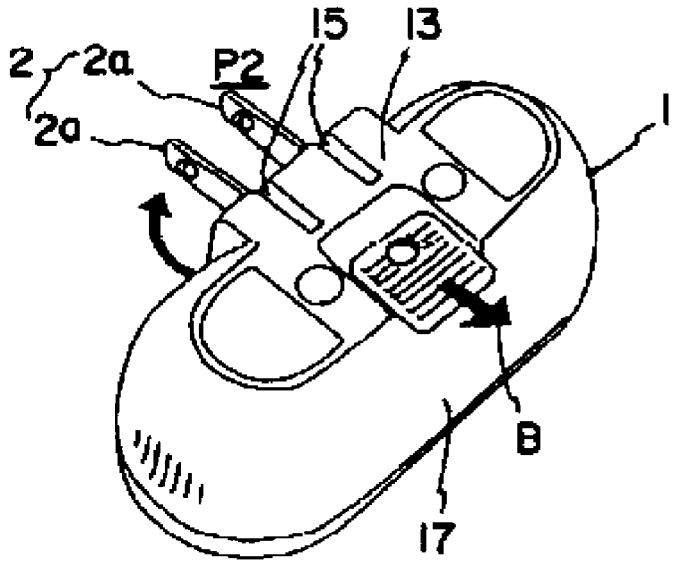
FIG. 6 is an oblique view of the above plug-in heater when it is turned over.
Figure 7:
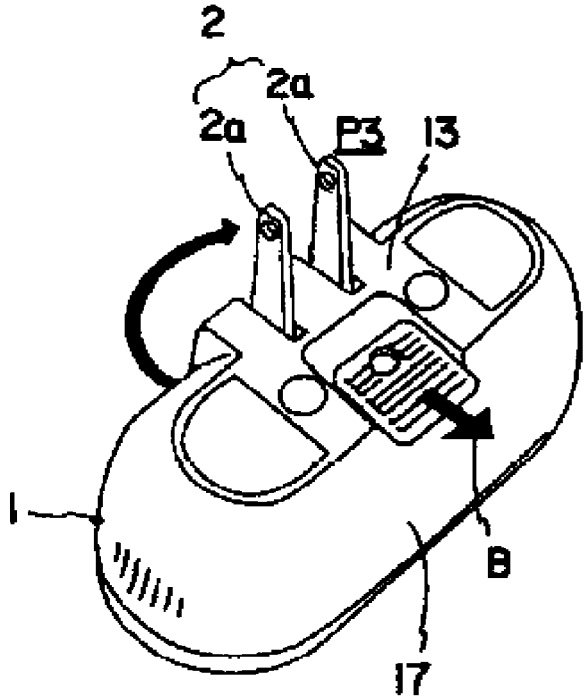
FIG. 7 is an oblique view of the above plug-in heater when it is turned over.

Furthermore, FIG. 1 shows the state in which power plug 2 is positioned at the upward storing position P1 by utilizing a solid line, and the state in which power plug 2 is positioned at the rear-side protruding position P2 and lower-side protruding position P3 by utilizing a virtual line. Moreover, FIG. 2 shows the state in which power plug 2 is positioned at the rear-side protruding position P2 by utilizing a solid line, and the state in which power plug 2 is positioned at the upward storing position P1 and lower-side protruding position P3 by utilizing a virtual line. FIG. 3 shows the state in which power plug 2 is positioned at the upward storing position P1 by utilizing a solid line, and the state in which power plug 2 is positioned at the lower-side protruding position P3 by utilizing a virtual line. FIG. 5 shows the state in which power plug 2 is positioned at the upward storing position P1, FIG. 6 shows the state in which power plug 2 is positioned at the rear-side protruding position P2, and FIG. 7 shows the state in which power plug 2 is positioned at the lower-side protruding position P3.

Power plug 2 is formed in a rotatable manner in the vertical direction between the upward storing position P1 and the lower-side protruding position P3, as rotating axis 20 is rotatably supported in bracket 16 formed on main body case 1; in addition to the above, power plug 2 is positioned and fixated through the locking means at the positions of P1, P2 and P3. Through the utilization of the locking means, power plug 2 is securely fixated at the positions of P1, P2, and P3, and thus, it becomes possible to control the relative movements of power plug 2 and main body case 1 to secure safety.

The locking means in the working example comprises latching member 3, which is formed to be integrated with rotating axis 20 of power plug 2; and locking member 4, which slides between a locking position (the position shown in FIG. 1) and an unlocking position (the position shown in FIG. 2) in the front-and-back direction (the direction shown by Arrow A in FIG. 1 and FIG. 2) of the main body case and is latched together with latching member 3 above in a mountable/removable manner.

Latching member 3 above is formed in a manner so that the cross-sectional shape of rotating axis 20 in the direction orthogonal to the axis is square. Latching hole 30 is respectively formed on each of three facets from among the four facets of the square, which face front surface 17 of main body case 1 when power plug 2 is positioned at the P1, P2 and P3 positions.

Locking member 4 is supported by guiding member 45 formed to be integrated with main body case 1, in a slidable manner in the front-and-back direction; it comprises perpendicular surface 40, which comes into contact with the front surface and the upper surface of latching member 3 when power plug 2 is positioned at the P1, P2, and P3 positions, as well as stopper lug 41, which becomes engaged with latching hole 30 stated above. Moreover, locking member 4 stated above is linked with finger plate 43 through long hole 42 formed to be long in the front-and-back direction on lower surface 13 of main body case 1; it is ordinarily energized by spring 44 in the direction facing latching member 3 above.

Therefore, when the plug-in heater is not in use, power plug 2 is positioned at the upward storing position P1. At this time, as shown in FIG. 1, locking member 4 causes perpendicular surface 40 to come into contact with the front surface and the upper surface of latching member 3, and it causes stopper lug 41 to be engaged with latching hole 30. Thus, it becomes possible to position and fixate power plug 2 at the upward storing position P1.

Moreover, when the plug-in heater is in use, power plug 2 is positioned either at the rear-side protruding position P2 shown in FIG. 6 or the lower-side protruding position P3 shown in FIG. 7, depending on the location of the power socket. In this case, when a finger is placed on finger plate 43 stated above to shift it in the direction of front surface 17 (the direction shown by Arrow B in FIG. 1, FIG. 6, and FIG. 7), it causes locking member 4 to slide in the direction of front surface 17, against the energization provided by spring 44. Triggered by the above-stated action, locking member 4 is caused to shift from the locking position shown in FIG. 1 to the unlocking position shown in FIG. 2, and becomes separate from latching member 3, which makes it possible to rotate the power plug around rotating axis 20 in the vertical direction. Moreover, when the finger is released from finger plate 43 with power plug 2 shifted to the rear-side protruding position P2 or the lower-side protruding position P3, locking member 4 shifts from the unlocking position to the locking position due to the energization provided by spring 44, and thus it becomes possible to fixate power plug 2 at either the rear-side protruding position P2 or the lower-side protruding position P3.

As stated above, when power plug is positioned at the upward storing position P1, it becomes possible to accommodate power plug 2 within plug-storing groove 15 formed on the rear surface 14 of main body case 1, and power plug 2 does not greatly protrude from main body case 1. Thus, the entirety of the plug-in heater can be formed in a compact size, and the resulting plug-in heater can be effectively utilized as a portable plug-in heater. Moreover, as standbosses 11 are provided in a protruding condition on the upper surface of main body case 1 from the beginning, the tip of power plug protruding from the upper surface of main body case 1 is not problematic at all. In this manner, as the tip of power plug 2 slightly protrudes from the upper surface 10 of main body case 1, the user can use the protruding tip as a handle.

Furthermore, in using the plug-in heater, as power plug 2 can be arbitrarily positioned at either the rear-side protruding position P2 or at the lower-side protruding position P3, the user can insert power plug 2 [into an appropriate electrical outlet] even when the electrical outlet is located at different locations at housing facilities.

Furthermore, when utilizing the plug-in heater overseas, in consideration of the fact that the shapes of electrical outlets vary depending on the country, an adaptor that matches the shape of the electrical outlet of the particular target country should be utilized, if the power plug of the present invention cannot be utilized. [Explanation of the Reference Numerals]

1: Main body case
10: Upper surface
11: Standboss
12: Terminal socket
13: Lower surface
14: Rear surface
15: Plug-storing groove
17: Front surface
2: Power plug
20: Rotating axis
3: Latching member (Locking means)
30: latching hole
4: Locking member (Locking means)
40: Perpendicular surface
41: Stopper lug
43: Finger plate
44: Spring
45: Guiding member
H: Hot curler
P1: Upward storing position
P2: Rear-side protruding position
P3: Lower-side protruding position

The invention claimed is:

1. A plug-in heater for hot curlers comprising: standbosses (11) for hot curlers on upper surface (10) of main body case (1), a terminal socket (12) for connecting a plug-in terminal (T) for hot curlers (H) provided inside of the standbosses, and a power plug (2) electrically connected to the terminal socket incorporated within the main body case, wherein a plug-storing groove (15) is formed on the rear surface (14) of the main body case extending from the upper surface to the lower surface (13) of the main body case, the base of the power plug is rotatably supported by means of an axis at a lower position within the plug-storing groove, the power plug is formed so as to be positioned around the rotatably-supporting point at an upward storing position (P1) at which the tip of the power plug slightly protrudes from the upper surface of the main body case, at a rear-side protruding position (P2) at which the tip of the power plug protrudes from the rear side of the main body case, and at a lower-side protruding position (P3) at which the tip of the power plug protrudes from the lower surface of the main body case, and locking means (3) and (4) for fixating the power plug at the upward storing position, rear-side protruding position, and lower-side protruding position.

* * * * *